US006131649A

United States Patent [19]

Pearl et al.

[11] Patent Number: 6,131,649

[45] Date of Patent: Oct. 17, 2000

[54] HEAT EXCHANGE APPARATUS

[75] Inventors: Steven R. Pearl, Nashua, N.H.; Charles D. Christy, Schiltigheim, France

[73] Assignee: Millipore Corporation, Bedford, Mass.

[21] Appl. No.: 09/513,738

[22] Filed: Jan. 22, 1999

Related U.S. Application Data

[63] Continuation of application No. 08/933,677, Sep. 9, 1997, abandoned.

[51] Int. Cl.[7] ..... F28D 9/00

[52] U.S. Cl. ..... 165/167; 165/905; 165/DIG. 366

[58] Field of Search ..... 165/70, 166, 167, 165/905

[56] References Cited

U.S. PATENT DOCUMENTS

| | | | |
|---|---|---|---|
| 2,221,937 | 11/1940 | Astle | 165/167 |
| 3,099,520 | 7/1963 | Hallstrom | 165/167 |
| 4,744,414 | 5/1988 | Schon | 165/167 |
| 4,854,382 | 8/1989 | Funke | 165/167 |

OTHER PUBLICATIONS

R. J. J. Jachuck and C. Ramshaw, "Process Intensification: Polymer Film Compact Heat Exchanger (PFCHE)" Trans IChemE, vol. 72, Part A, Mar. 1994 (pp. 255–262) (8 pages).

*Primary Examiner*—Allen Flanigan
*Attorney, Agent, or Firm*—J. Dana Hubbard, Esq.; Timothy J. King, Esq.; Paul J. Cook, Esq.

[57] ABSTRACT

A heat exchange apparatus is provided which is formed from at least one multilayer presealed element and at least one monolayer element that are insert molded together. The heat exchange apparatus is provided with an inlet and an outlet for a process fluid and at least one inlet and at least one outlet for a heat exchange fluid. The sealing configuration of the presealed elements and the seal provided by the insert molding effect a seal configuration that causes heat to be transferred between the process fluid and the heat exchange fluid while preventing mass transfer between the two fluids.

9 Claims, 15 Drawing Sheets

HEAT EXCHANGE APPARATUS

This is a continuation application U.S. Ser. No. 08/933,677, filed Sep. 9, 1997 now abandoned.

BACKGROUND OF THE INVENTION

1. Field of the Invention

This invention relates to a heat exchange apparatus and, more particularly, to a heat exchange apparatus formed of a polymeric composition.

2. Description of the Prior Art

At the present time, heat exchange apparatus for regulating the temperature of a process fluid are formed to provide a flow path for process fluid and a flow path for a cooled or heated heat exchange fluid which either provides heat or extracts heat from the process fluid. The heat transfer between the fluids generally is effected through a thin, heat conductive barrier such as a thin wall of a conduit. The vast majority of presently available, commercially-used heat exchange apparatus are made of a metal such as stainless steel.

The use of metals for forming a heat exchange apparatus provides certain significant disadvantages, including being heavy and costly. Since metals are good conductors of heat, the atmosphere surrounding the heat exchanger provides either a source of unwanted heat to a coolant fluid or an unwanted extractor of heat from a heating fluid used in the heat exchanger. In addition, the use of metals when processing corrosive fluids is quite limited and, generally results in the required use of specialized, expensive metals. In addition, most metals are easily wet with liquids, such as aqueous liquids which, in turn, promote their interaction with the liquid, such as by chemical reaction, and fouling of the metal.

Accordingly, it would be desirable to provide a heat exchange apparatus having high heat exchange efficiencies. Also, it would be desirable to provide such an apparatus which can be easily formed.

SUMMARY OF THE INVENTION

The present invention provides a heat exchange apparatus formed entirely or substantially entirely of a polymeric composition. The heat exchange apparatus is provided with at least one passageway for a process fluid to which heat is to be provided or from which heat is to be extracted and at least one passageway for a heat exchange apparatus fluid which provides heat or extracts heat from the process fluid. The heat exchanger of this invention is formed to include both passageways and a heat exchange barrier between the passageways which permits heat transfer between the fluids within the passageways while preventing mass transfer of fluid between the passageways. The passageways can include screens which promote fluid turbulence which, in turn, promotes heat transfer. The heat exchanger is provided with a fluid inlet and a fluid outlet for the heat exchange fluid. Heat transfer is effected through a thin barrier such as a polymeric barrier, a metal barrier or a metal-polymeric laminate barrier.

The heat exchange apparatus of this invention is formed by molding screens defining the fluid passageways and heat transfer layers in a configuration which prevents admixture of the heat exchange fluid and the process fluid during use of the apparatus. The heat exchange apparatus also includes a fluid inlet and a fluid outlet for the heat exchange fluid and a fluid inlet and a fluid outlet for the process fluid. End caps can be provided to seal the process fluid and the heat exchange fluid within their designated passageways, inlet and outlet.

BRIEF DESCRIPTION OF THE DRAWINGS

FIG. 10 is a graph heat transfer coefficient as a function of mass flow of a fourth embodiment of Example 1.

FIG. 10 is a graph heat transfer coefficient as a function of mass flow of a fifth embodiment of Example 1.

FIG. 10 is a graph heat transfer coefficient as a function of mass flow of a sixth embodiment of Example 1.

FIG. 10 is a graph heat transfer coefficient as a function of mass flow of a seventh embodiment of Example 1.

FIG. 10 is a graph heat transfer coefficient as a function of mass flow of a eighth embodiment of Example 1.

DESCRIPTION OF SPECIFIC EMBODIMENTS

Figure 1:
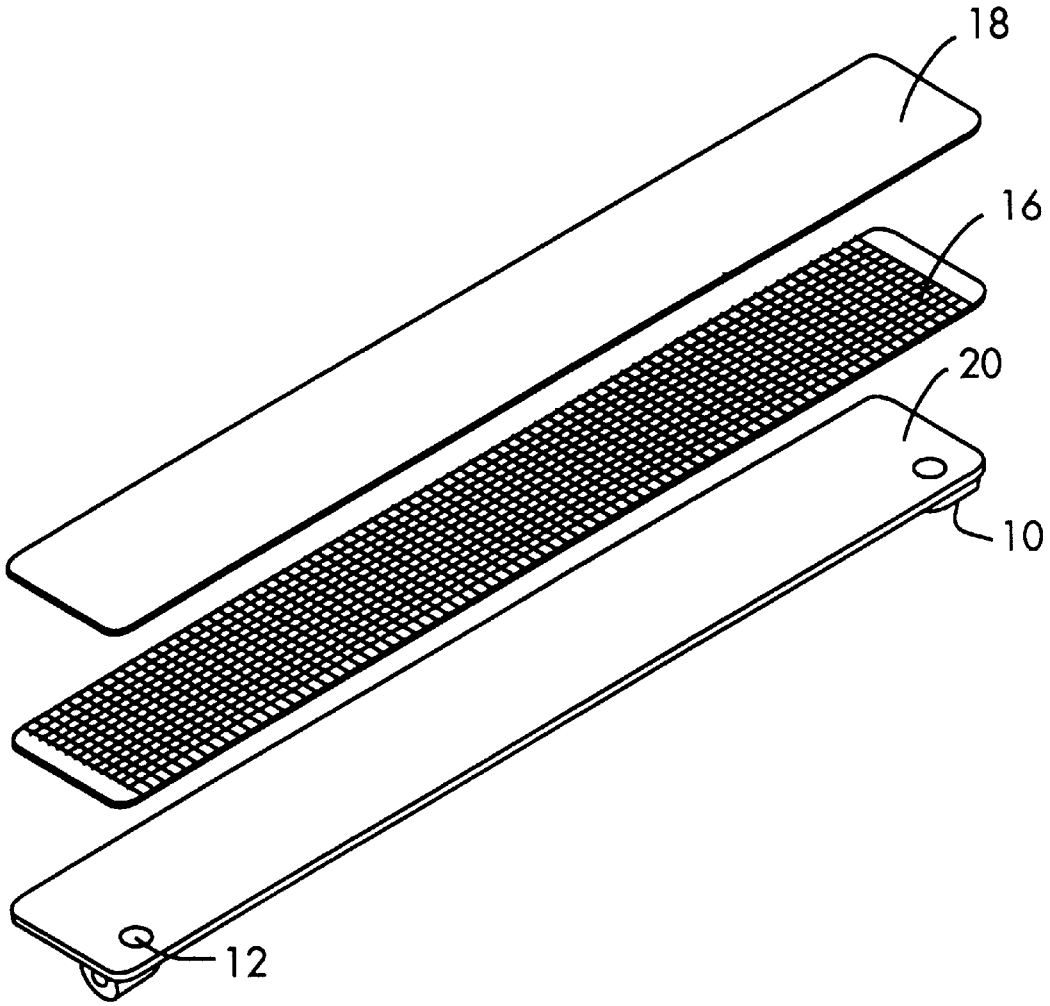
FIG. 1 shows the components of a heat exchange useful in forming the heat exchange apparatus of this invention.

The heat exchange apparatus of this invention is formed from a stack of elements including a nonporous, heat transfer layer and spacer layer. The spacer layers provide a flow path for a process liquid stream and a heat exchange fluid stream. The heat transfer layer(s) and spacer layer(s) are referred to collectively herein as "working layers". Elements referred to herein as modules are formed from two or three components, at least one of which is a nonporous heat transfer layer and at least one of which is a spacer layer. The three component module can be formed from two heat transfer layers, each positioned on a surface of a spacer layer. The spacer layer can comprise a defined open volume or a porous single layer such as a screen. When utilizing an open volume as the spacer layer, it is formed with one or two mating rims forming the perimeter of the open volume which separates modules or separates a module and an end of the heat exchange apparatus. The modules can be formed from more than three working layers, if desired so long as the spacer layers and the heat transfer layers are in alternating strata. By arranging the spacer layers and heat transfer layers in this configuration, desired heat transfer can be effected while avoiding undesired mass transfer. The spacer layer comprises an element having holes, channels or an open volume through which liquid can pass. The spacer layer is contiguous to or contacts a heat transfer layer through which heat is transferred between the process liquid stream and the heat exchange fluid stream.

Modules forming a portion of the stack are presealed prior to being positioned within the stack and thereafter insert molded. The presealed configuration of the module will depend upon the position of the element within the stack. The module can include either a spacer layer for a process stream or a spacer layer for a heat exchange stream. When the module includes a process stream spacer layer, the module is presealed so that the process stream spacer layer is open to the process stream inlet port and the process stream outlet port in the heat exchange apparatus and is closed to the heat exchange stream inlet and outlet ports. When the module includes the heat exchange stream spacer layer, the module is presealed so that the process stream spacer layer is closed to the heat exchange stream inlet and outlet ports and is open to the process stream and outlet ports. The monolayer elements within the stack forming the heat exchange apparatus comprise either spacer layers or heat transfer layers. The heat transfer layer utilized in the stack is thin and can comprise a polymeric layer, a metal layer or a laminate comprising metal layers such as aluminum and a polymeric layer.

Representative suitable polymeric compositions for forming the heat exchange apparatus of this invention have a thermal conductivity less than about BTU-inch/20 Hr-$Ft^2$-° F. and preferably between about 1 and about 3 and include polyimides, polyetheretherketone (PEEK), cellulose, polypropylene, polyethylene polyvinylidene difluoride (PVDF), polysulfone, perfluorocelkoxy resin (PFA), polysulfone, polyethersulfone, polycarbonate, acrylonitrile-butadiene-styrene, polyester, polyvinyl chloride (PVC), acrylics, polytetrafluoroethylene, fluorinated ethylene polymer, polyamide or the like, or blends thereof, filled or unfilled. The non-porous heat transfer layer can be formed of a polymeric composition including polymeric compositions set forth above for the heat exchange apparatus, a metal layer such as aluminum or stainless steel or a laminate of a polymeric composition and a metal layer. It is preferred to utilize a metal layer having a thermal conductivity of at least about 60, preferably at least about 110 in order to increase the rate of heat transfer. Generally, the heat transfer layer has a thickness between about 0.5 to 10 mil and about 10, preferably between about 2 and about 3 mils.

Suitable polymeric sealing compositions are those which provide the desired sealing configuration within the filtration apparatus and do not significantly degrade the elements forming the apparatus including the heat transfer layers, spacer layer ports and housing elements. In addition, the sealing composition should not degrade or provide a significant source of extractables during use of the apparatus. Representative suitable sealing compositions are thermoplastic polymer compositions including those based on polymeric compositions set forth above for the heat exchange apparatus.

Sealing can be effected by any conventional means including insert molding fusion, vibrational bonding, adhesives or the like.

Figure 2:
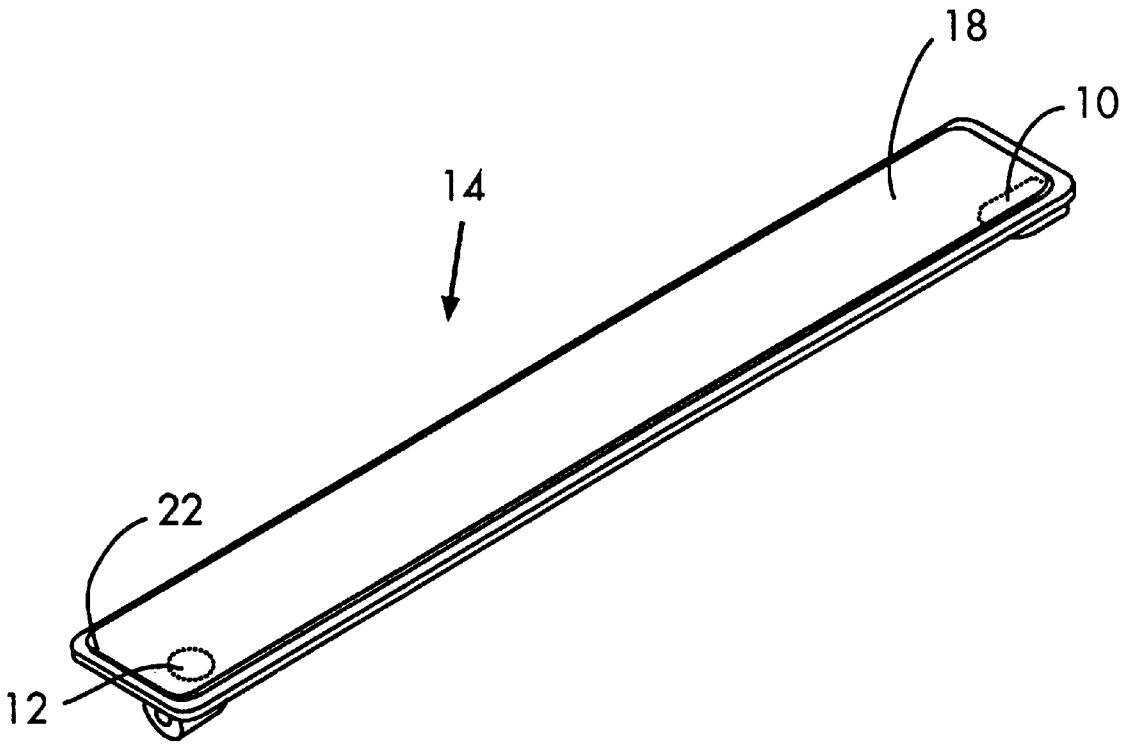
FIG. 2 shows the components of FIG. 1 molded together.
Figure 3:
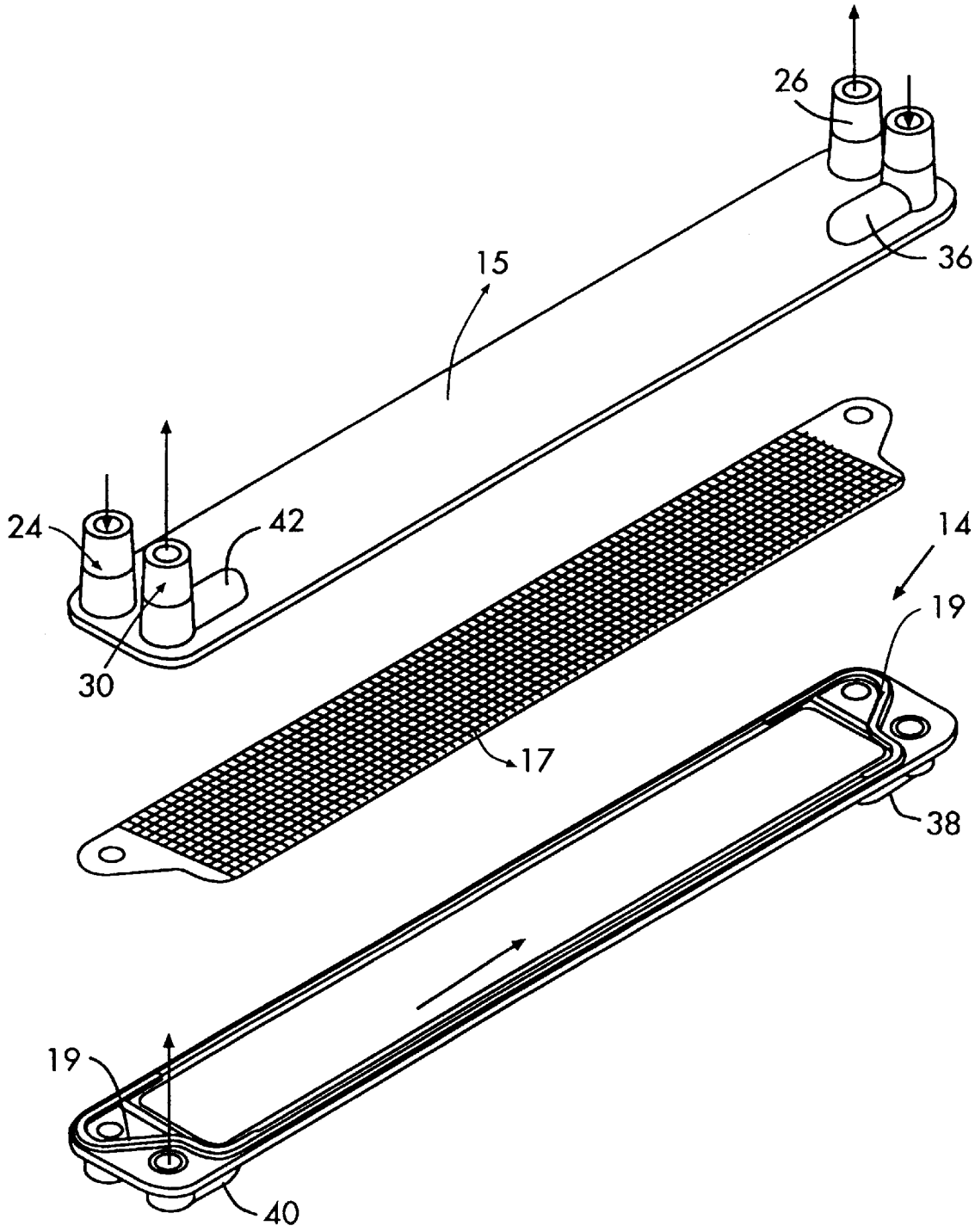
FIG. 3 illustrates the formation of a heat exchange apparatus of this invention.
Figure 6:
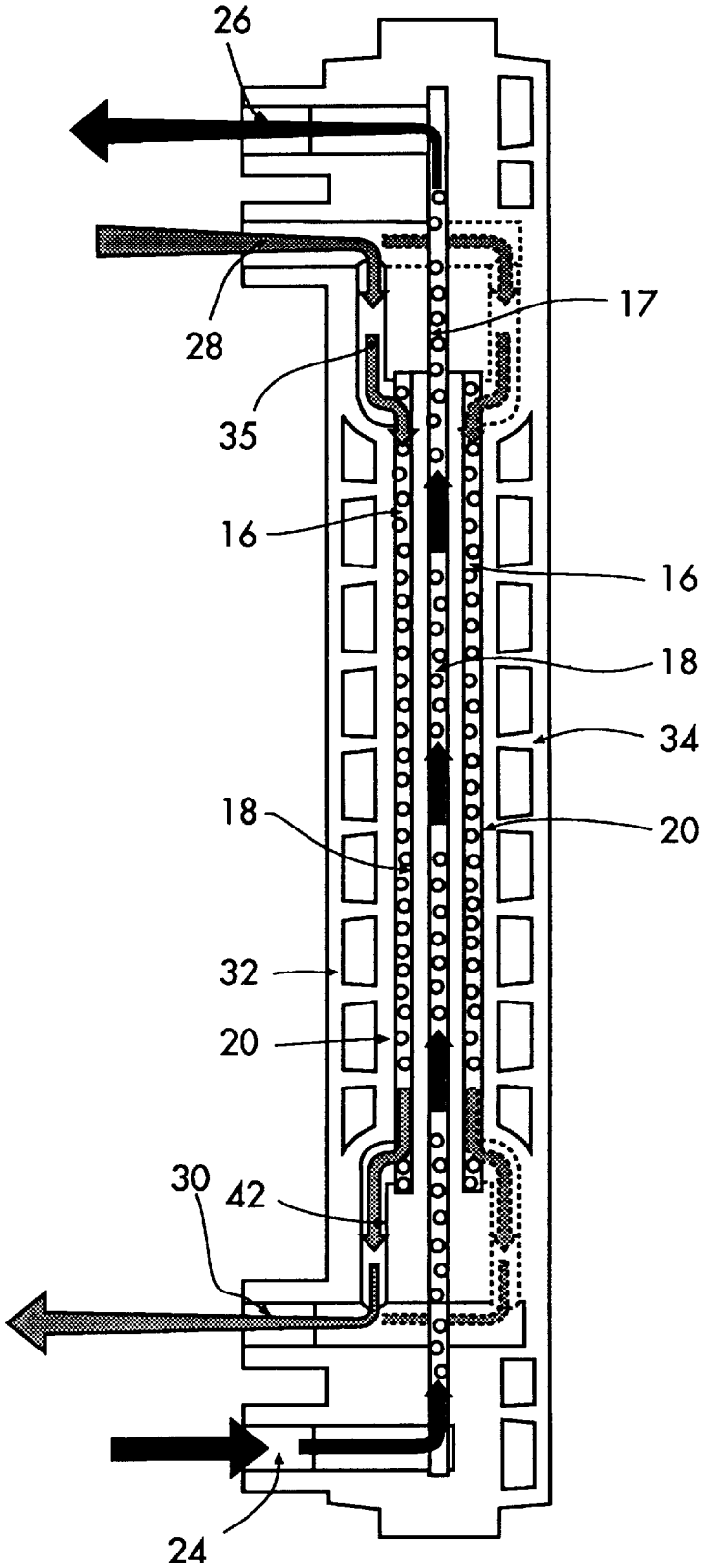
FIG. 6 illustrates the use of the apparatus of FIG. 5.

Referring to FIGS. 1 and 2, a heat exchange apparatus of this invention is formed from a spacer layer 16 for heat exchange liquid which can comprise a screen or the like, heat transfer layer 18 and end cap 20 which include a heat exchange liquid inlet port 10 and a heat exchange liquid outlet port 12. The module 14 is formed by placing the heat transfer layer 18 and spacer layer 16 and the end cap 20 in a mold and molding a plastic composition around the layers and selectively into the layers to form a first seal about the layers and to form a peripheral raised rib 22 (FIG. 2). Module 15 is also formed from a heat transfer layer, a spacer layer and an end cap 23. End cap 23 differs from end cap 20 in that it includes a process fluid inlet port 24, a process fluid outlet port 26, a heat exchange fluid inlet 28 and a heat exchange fluid outlet 30. The sealing lip 19 extends about the circumference of module 15 and mates with a sealing lip (not shown) on module 15 to effect a seal between the heat exchange fluid and the process fluid. The modules 14 and 15 as well as the spacer layer 17 are positioned between anti-deflection caps 32 and 34 within a mold and all of these elements are joined together to form a second seal by being insert molded within the mold. The caps 32 and 34 and wall 35 form a housing for heat exchanger 36. The anti-deflection caps 32 and 34 serve to strengthen the heat exchange apparatus 36 (FIG. 4) so that it can withstand high internal pressure. As shown in FIG. 6, heat exchange fluid is introduced into inlet 28 and directed by conduits 35 and 38 into spacer layers 16 positioned within modules 14 and 15. Heat exchange fluid is removed from heat exchange apparatus 37 from outlet 30 which is in fluid communication with conduits 40 and 42 which, in turn, are in fluid communication with spacer layers 16 in modules 14 and 15. Process fluid is introduced into heat exchange apparatus 36 through inlet 24, is passed through space layer 17 and is removed through outlet 26.

Figure 7:
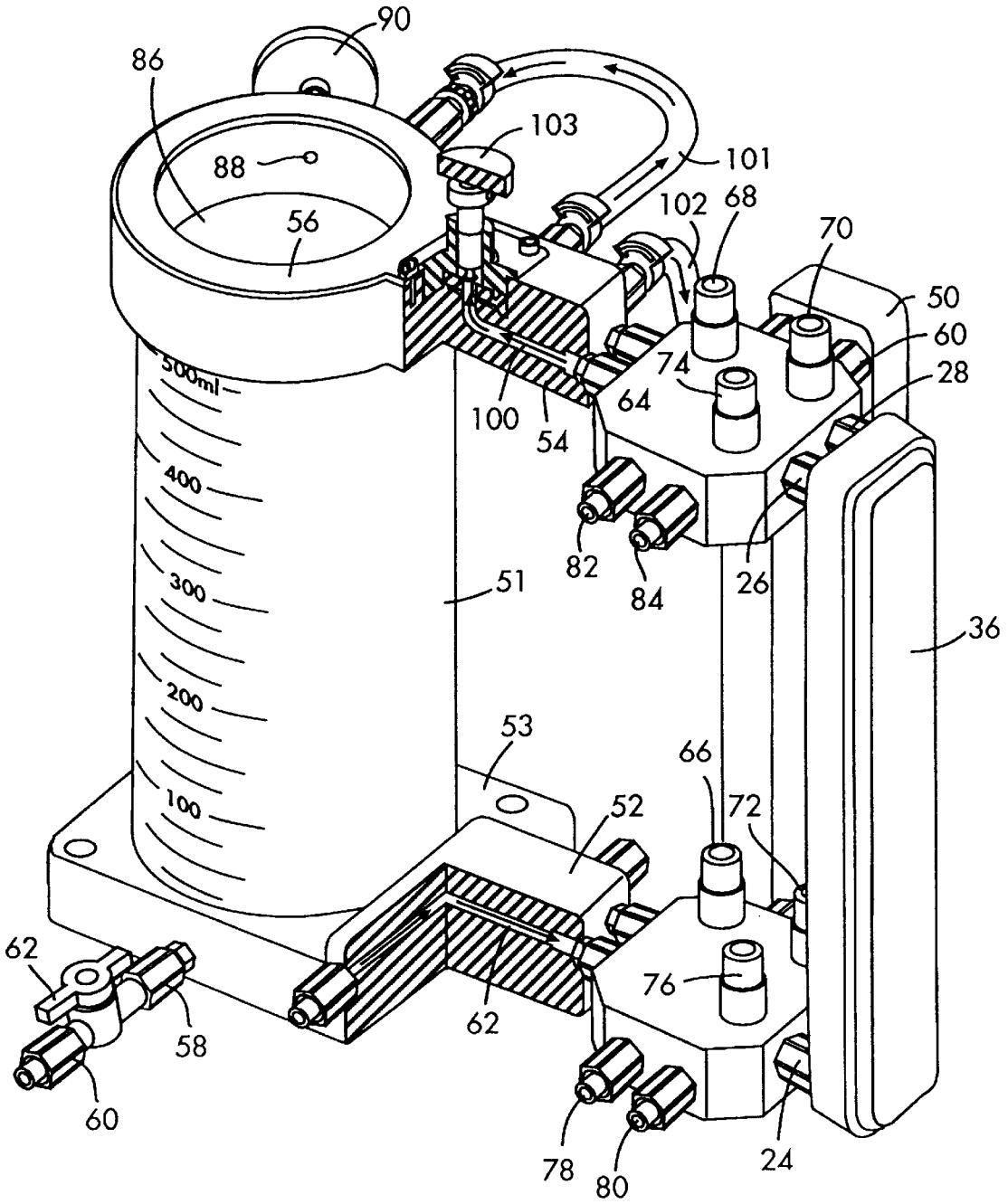
FIG. 7 shows a fluid processing system utilizing the heat exchange apparatus of this invention.

Referring to FIG. 7, the heat exchange apparatus 36 of this invention can be used in conjunction with a filtration module 50. A reservoir 51 for a process fluid is connected to filtration apparatus 50 by two manifolds 52 and 54 which provide fluid communication between the reservoir 51 and filtration module 50. The manifold 52 is formed integrally with the reservoir 51 or it can be formed integrally with a separate flange element 56 which can be fit onto a top portion of reservoir 51. A connector 54 in fluid communication with reservoir 51 and connector 60 is in fluid communication with a pump (not shown) such as with a tubular conduit (not shown) when valve 62 is open. Manifold 52 can be formed integrally with a support 53 for reservoir 84 as shown. The manifolds 52 and 54 are formed integrally with the reservoir 51 or with elements which interface with the reservoir 51 rather than with the filtration module 50 because the filtration module 50 is periodically replaced rather than replacing the reservoir 51. Connector 60 is in fluid communication with the pump (not shown) when it is secured to a tubular conduit (not shown) which, in turn, is in fluid connection with the pump.

The connector 60 is in fluid communication with process fluid feed channel 62 for delivery of feed into heat exchange module 36 through feed channel 62. Process fluid enters heat exchange apparatus 36 through inlet 24 and exits through outlet 26 as described above with reference to FIG. 6. The process fluid then passes through manifold 64, through filtration module inlet 66 and into filtration module 50. Heat exchange fluid enters module 36 through inlets 70 and 28 and is removed through outlets 30 and 72. Additional permeate outlets 74 and 76 can be provided for a filtration module attached to connectors 78, 80, 82 and 84. Filtration module 50 is structured to separate a feed fluid into a permeate stream and a retentate stream and is disclosed in application Ser. No. 08/856,856 filed May 15, 1997, which is incorporated herein by reference. Permeate is removed from module 50 through outlets 66 and 68. Unfiltered retentate passes into retentate channel 100 to be passed through retentate tubular conduit 101 and to be recycled to reservoir 51.

When the opening 86 of reservoir 56 is sealed, air can enter reservoir 51 through port 88 which is sealed by a filter housing 90 including an air filter (not show). The air filter used is a conventional sterilizing filter. The incoming air to the reservoir can be rendered sterile when the filter used is a conventional sterilizing filter. The incoming air replaces discarded permeate thereby continuing filtration.

While the figures illustrate the use of the apparatus of this invention on a countercurrent flow process, the apparatus also can be used so that the process fluid and the heat exchange fluid flow concurrently. In addition, the space layer through which the heat exchange fluid and the process fluid pass can be reversed.

The following example illustrates the present invention and is not intended to limit the same.

EXAMPLE 1

Figure 4:
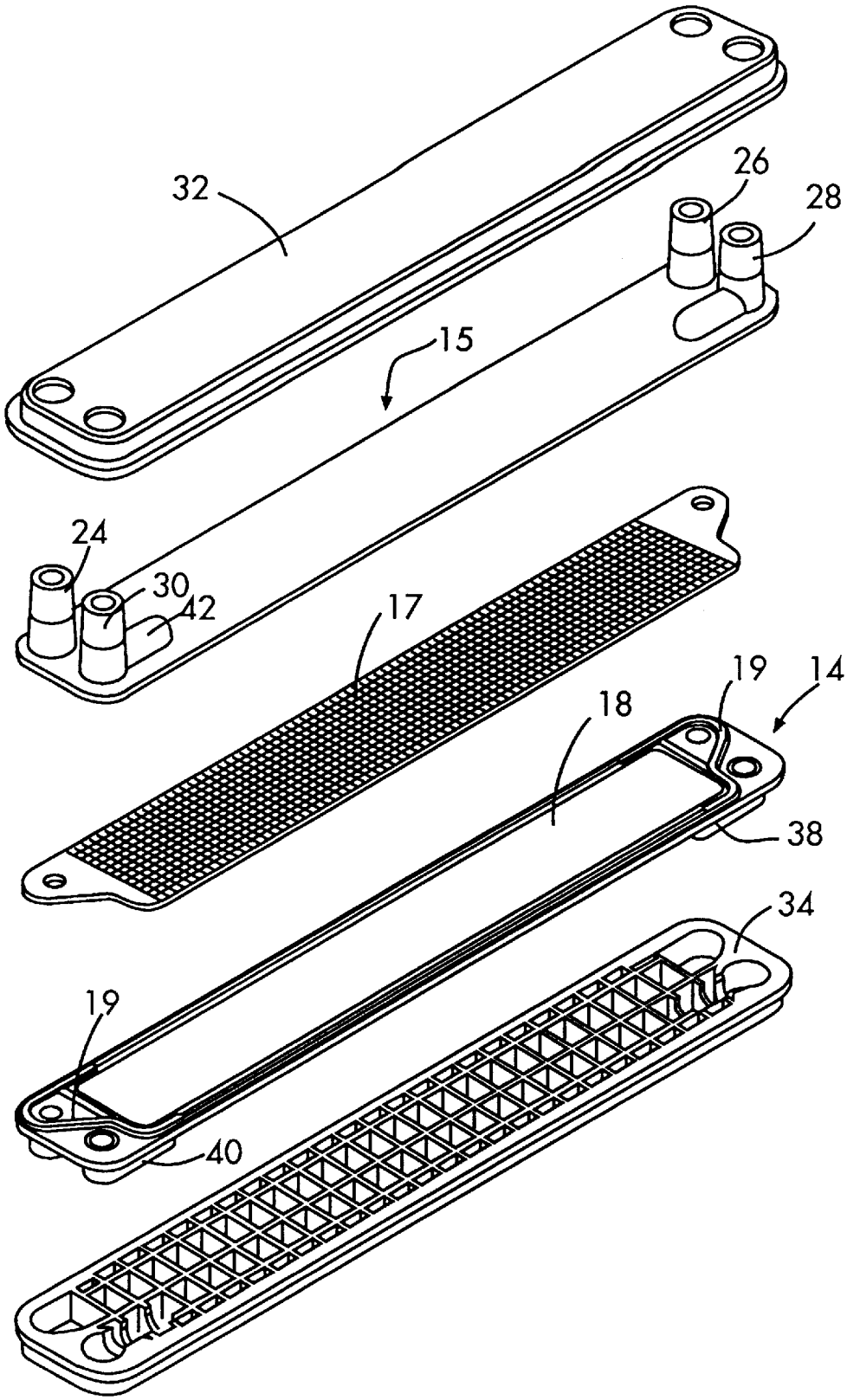
FIG. 4 illustrates including with the heat exchange apparatus of FIG. 3 with antideflection caps.
Figure 5:
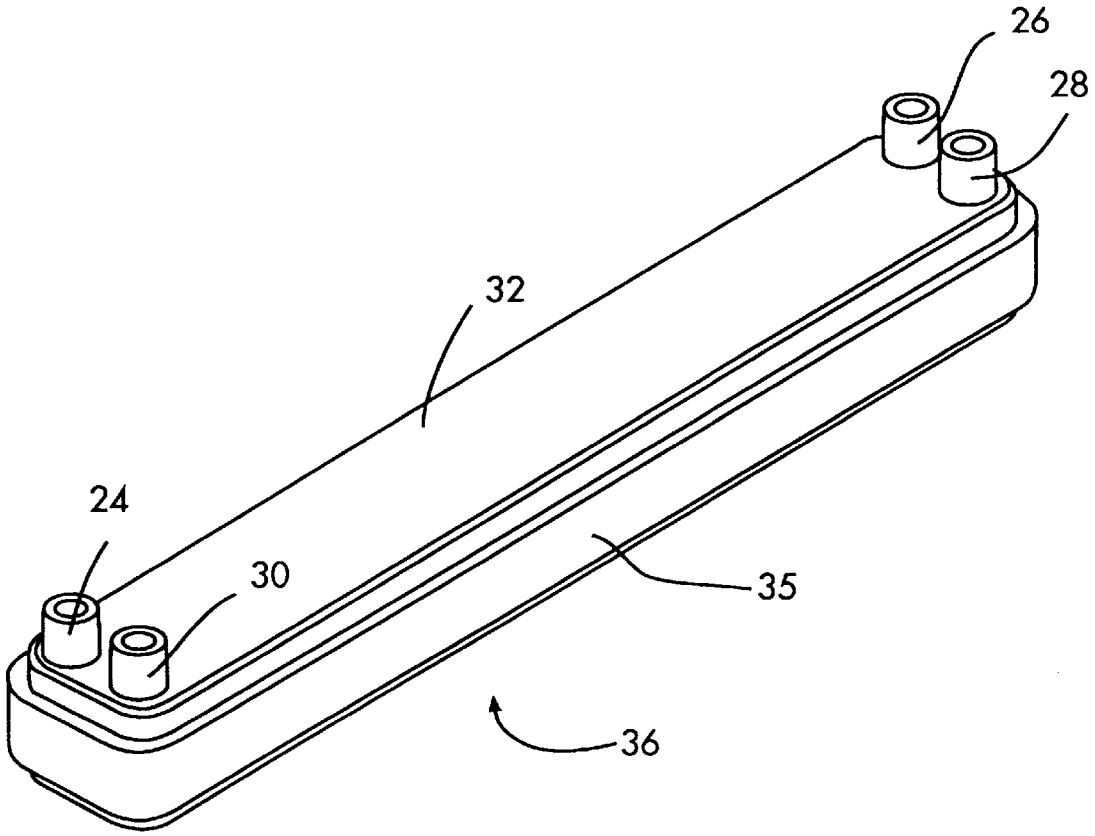
FIG. 5 shows the completed heat exchange apparatus of FIG. 4.

This example provides a determination of the overall heat transfer coefficient and the efficiency of the heat exchanger shown in FIGS. 4 and 5 using different flow rates and configurations.

In order to evaluate the heat exchanger properly, the overall heat transfer coefficient and the efficiency of the device need to be quantified. Since both of these properties are dependent on the flow rate, the relationship to the mass flow rate needs to be addressed. The definition of U, the overall heat transfer coefficient is:

$$U = \frac{Q}{A \cdot \Delta T_{LM}} \tag{1}$$

where Q is the heat transfer, A is the available area for heat transfer and $\Delta T_{LM}$ is the log mean temperature difference. Since A and $\Delta T_{LM}$ are readily measurable, the heat transferred the calculated via heat capacity of the fluids, U can be easily determined.

The efficiency of the exchanger is determined by dividing the heat transfer observed by the maximum heat transfer possible, $Q_{max}$. $Q_{max}$ is defined as:

$$Q_{max}=(mC_p)_{min}\cdot\Delta T_{max} \tag{2}$$

A signet flow meter is placed in-line with the heating/cooling fluid directed into the heat exchanger. The flow rate of the process fluid (water) was measured using a balance and stopwatch. Temperature measurements were made through four thermocouples individually located at the four inlet/outlet ports of the heat exchange device. These thermocouples were wired into the data acquisition package and their temperature values were collected every second. The block average function was used to log the average reading for the previous five seconds onto a Microsoft Excel Worksheet.

The cooling fluid was set to a flow rate of about 75 mi/min. The process fluid was run at different flow rates ranging from 10 and 80 mi/min. The process fluid was run at different flow rates ranging form 10 and 80 mi/min. The process fluid was not recirculated but was run once through, to model a steady state system. While the flow was being measured by weight for one minute, the temperature was also recorded so the appropriate temperatures could be used to evaluate the heat transfer properties at that flow rate measurement.

The same procedure as used with the cooling fluid was followed for the hot water tests except the flow rate was about 50 mi/min due to restrictions in pumping the hot water.

Experiments were run in four different configurations. Heat exchangers can be run two different ways, counter current or parallel flow. Additionally, the heating/cooling fluid can be run on the feed channel (inside), or the outside channels. All of these permutations were tested at different flow rates.

The results of the collected data using propylene glycol to cool the process fluid as shown in FIGS. 8–11. FIGS. 12–15 contain similar data except hot water was used to heat the process fluid. To convert from cal/($M^2$·min·° c.) to BTU/($ft^2$hr·° F.) multiply by 0.039816.

Figure 8:
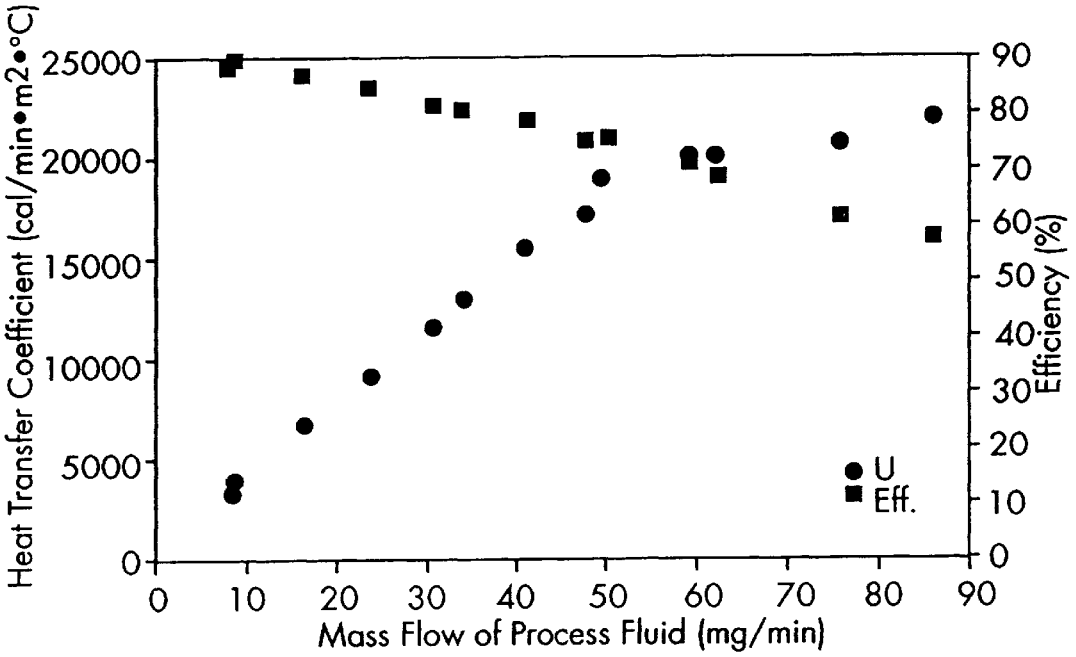
FIG. 8 is a graph of heat transfer coefficient as a function of mass flow of an embodiment of Example 1.
Figure 9:
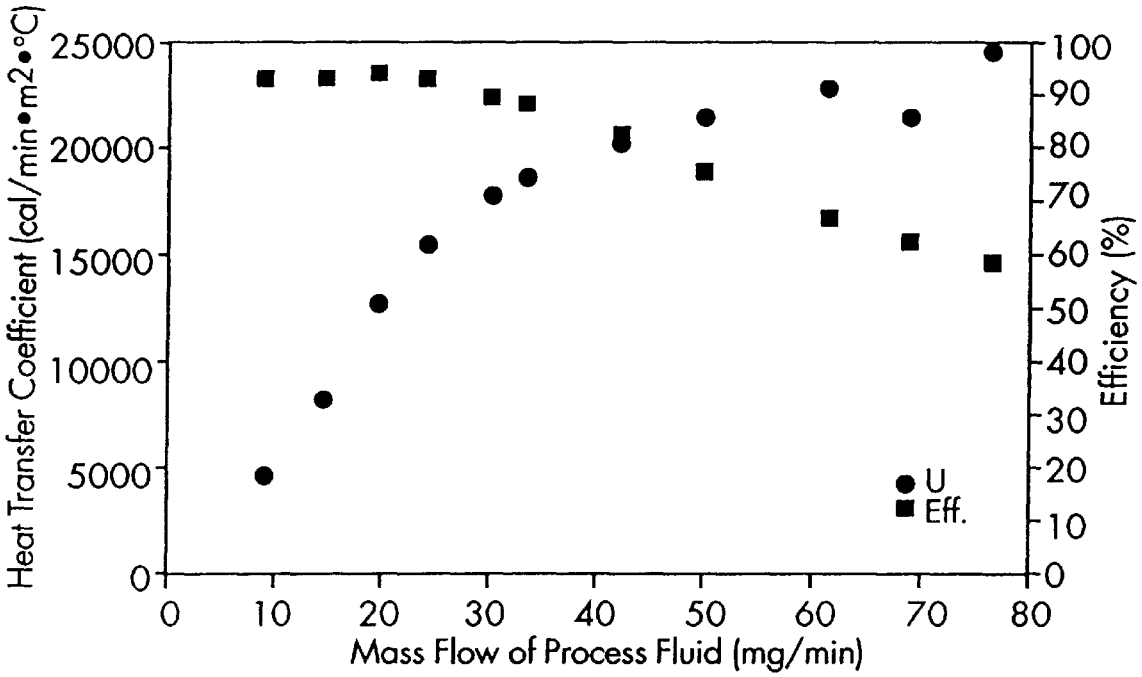
FIG. 9 is a graph of heat transfer coefficient as a function of mass flow of a second embodiment of Example 1.
Figure 10:
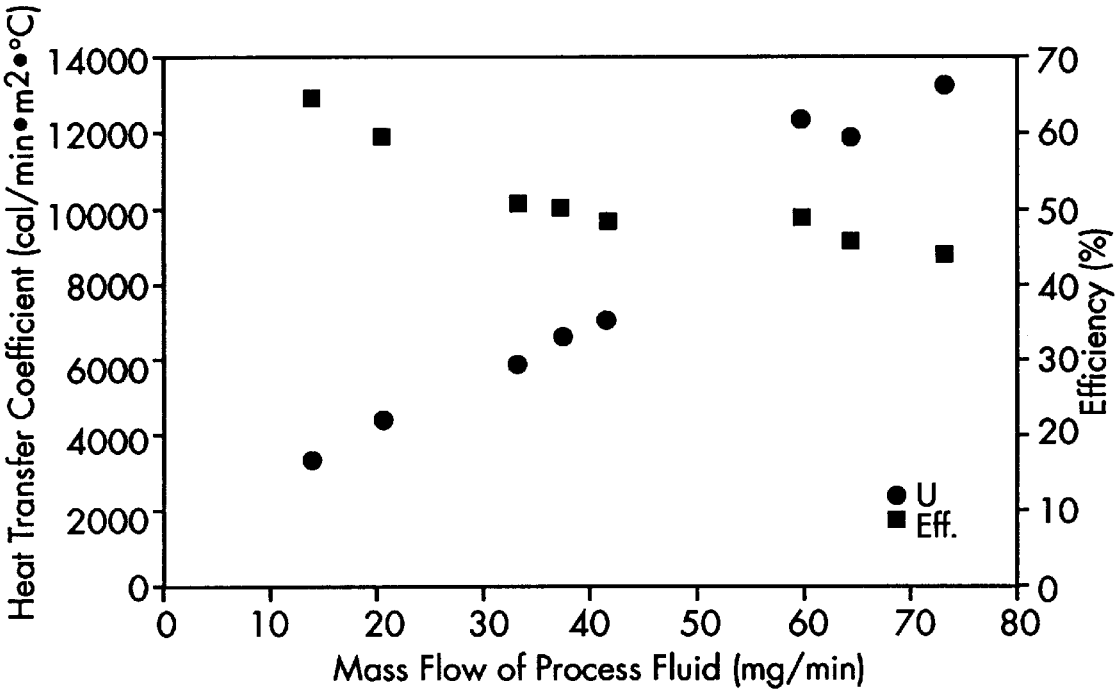
FIG. 10 is a graph heat transfer coefficient as a function of mass flow of a third embodiment of Example 1.
Figure 11:
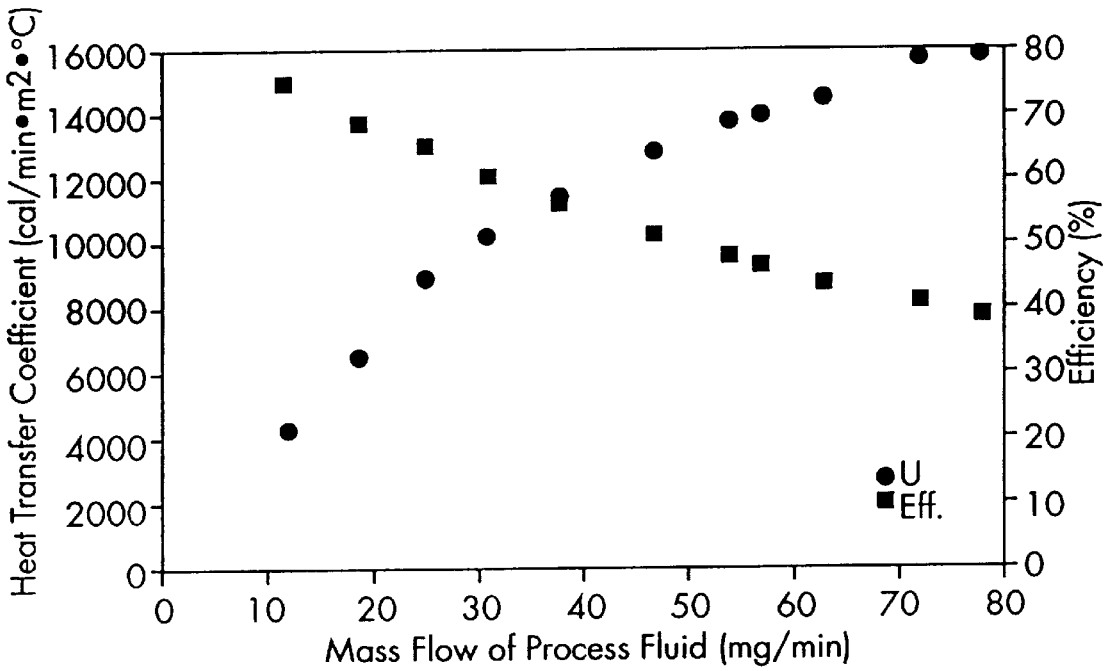
FIG. 11.
Figure 12:
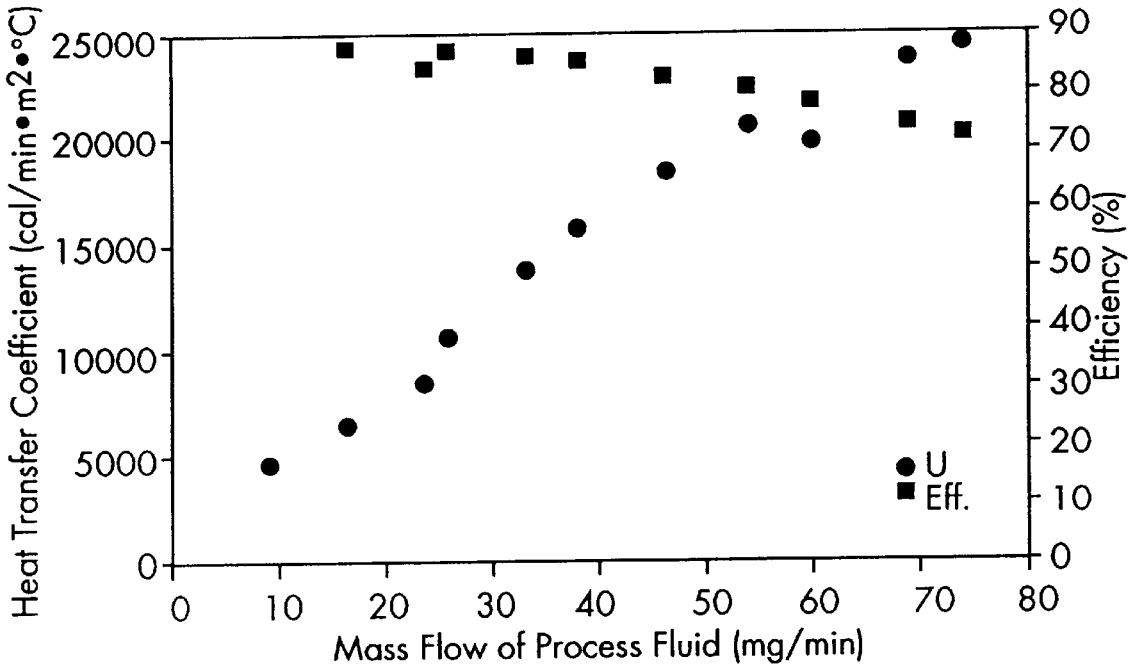
FIG. 12.
Figure 13:
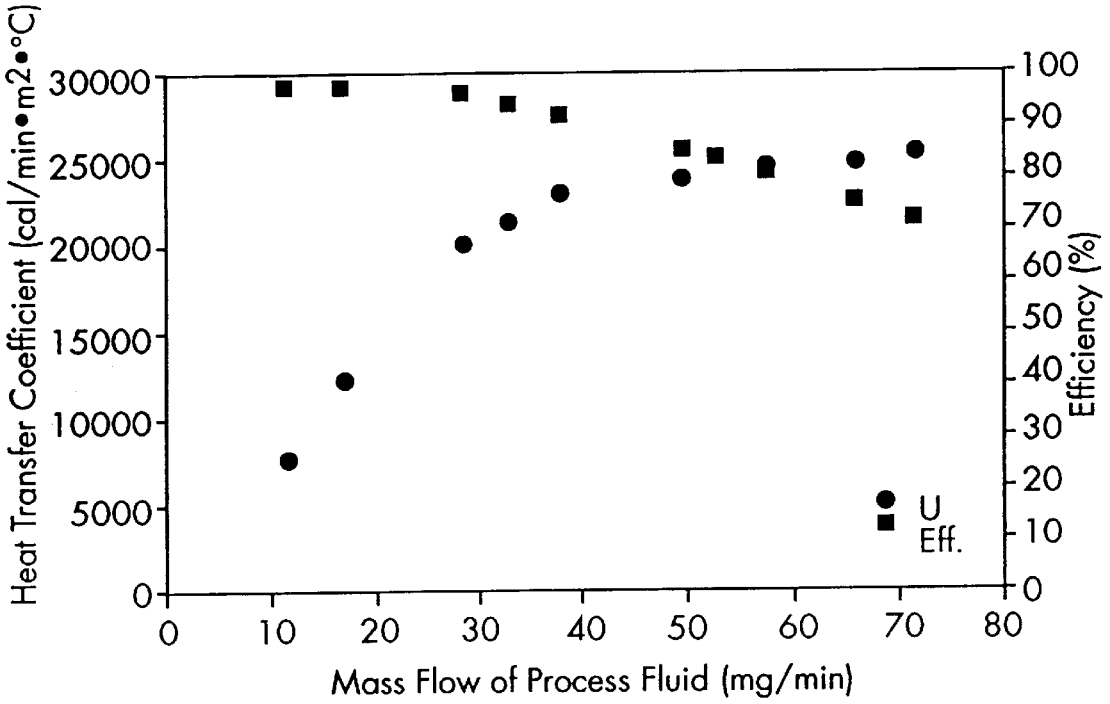
FIG. 13.
Figure 14:
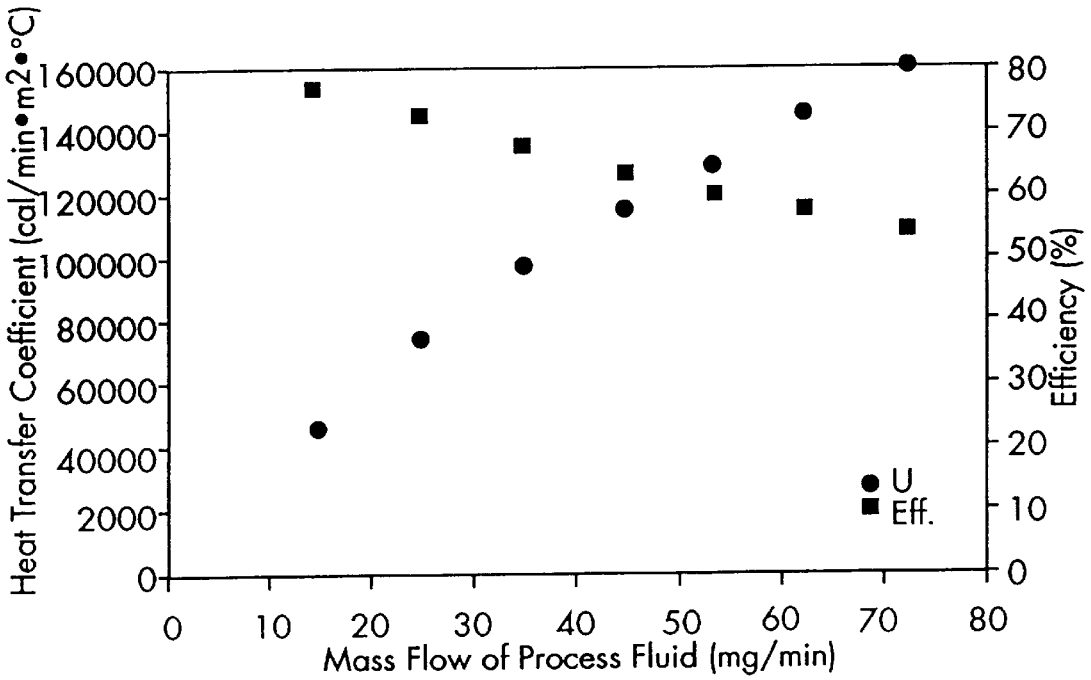
FIG. 14.
Figure 15:
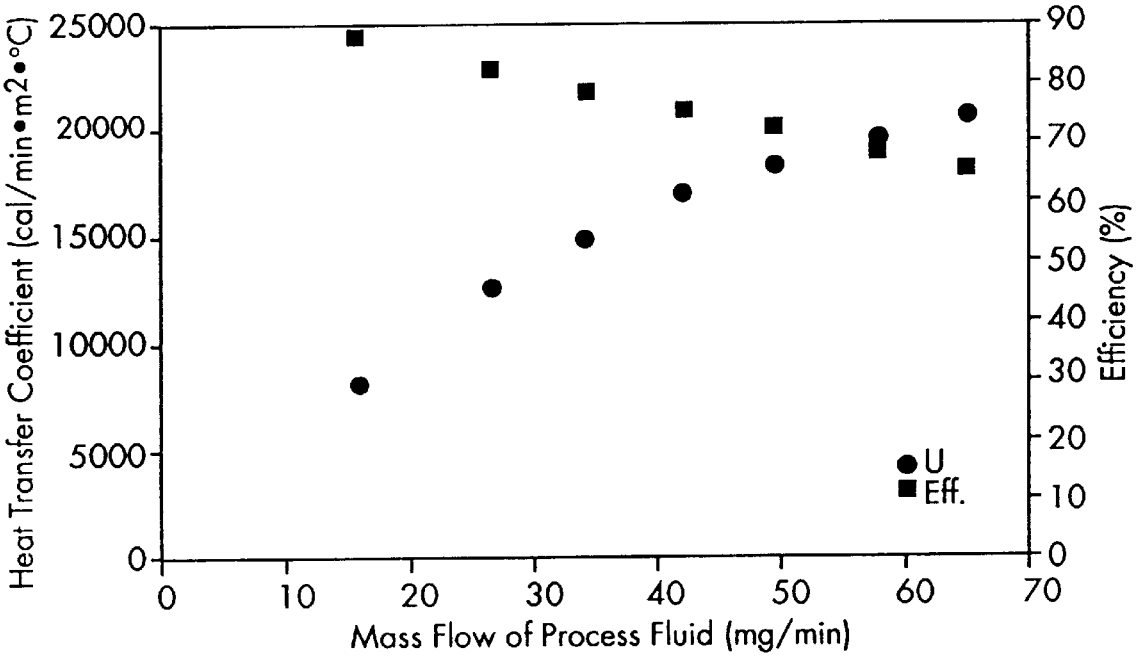
FIG. 15.

Based upon the graphs of FIGS. 8–15, the counter current exchanger produces a higher heat transfer coefficient and a higher efficiency than the parallel flow at the same flow rate. In terms of efficiency, the heat exchanger runs more efficiently when the heating/cooling fluid is pumped through the feed (center) channel. By running the heating. cooling fluid through the center channel, the loss to the environment is minimized. This is illustrated in FIGS. 8 and 12. Typical process flow rates for the heat exchanger is between 30 and 40 mi/min. In this range, the efficiency of the heat exchanger is 85% in the ideal configuration. However, this efficiency varies with both the flow rate of the process fluid and of the heating/cooling fluid.

The efficiency of the heat exchanger is 85% when the process flow rate is in the typical range of 30 to 40 ml/min. The heat exchanger is preferably run counter current with the heating/cooling fluid in the feed (center) channel to optimize the heat transfer. By running in this configuration, the heat loss to the environment is minimal compared to other arrangements. The counter current flow is preferable because the temperature driving force along the exchanger remains uniform when compared to parallel flow. The values for U are within or exceed the range of 150–300 BTU/(ft·hr·° F.) (or 2500 to 3700 from cal/($M^2$·min·° C.)).

What is claimed is:

1. A heat exchange apparatus for effecting heat exchange between a process fluid and a heat exchange fluid comprising:

a housing, including a wall and end caps positioned at opposing ends of said housings, at least one module layer including a least one heat transfer layer having an exterior surface formed of a polymeric composition and at least one first spacer layer formed of a polymeric composition, at least one process fluid inlet for a process fluid and at least one process fluid outlet for said process fluid, at least one heat exchange fluid inlet for a heat exchange fluid and at least one heat exchange fluid outlet for said heat exchange fluid, said at least one module layer being sealed with a thermoplastic polymer composition to form a perimeter seal about said at least one spacer layer and said at least one heat transfer layer to form a first seal which isolates said at least one process fluid inlet and said process fluid outlet from said at least one heat exchange fluid inlet and said at least one heat exchange fluid outlet, at least one second spacer layer formed of a polymeric composition positioned adjacent each said at least one module layer and being insert molded to each other to form a perimeter seal comprising said wall positioned about the periphery of said at least one second spacer layer and said at least one module layer so that said process fluid and said heat exchange fluid can be passed through said apparatus to effect heat transfer between said fluids while preventing mass transfer between said fluids and said housing being formed of a polymeric composition and each of said spacer layers being formed of a composition having a thermal conductivity less than about $$20\frac{\text{BTU-inch}}{\text{Hr-Ft}^2\text{-}^\circ\text{ F.}}.$$

2. The apparatus of claim 1 wherein said at least one module layer comprises an end cap, at least one first spacer layer and one heat transfer layer.

3. The apparatus of claim 1 including a second spacer layer at each end of said heat exchange apparatus and said at least one module layer comprising two heat transfer layers separated by a first spacer layer.

4. The apparatus of claim 1 including an end cap positioned on each second spacer layer at each end of said heat exchange apparatus.

5. The apparatus of any one of claims 1, 2, 3 or 4 wherein said housing is formed of a polyethylene.

6. The apparatus of any one of claims 1, 2, 3 or 4 wherein said housing is formed of a polypropylene.

7. The apparatus of any one of claims 1, 2, 3 or 4 wherein said thermal conductivity is between about 1 and about $$3\frac{\text{BTU-inch}}{\text{Hr-Ft}^2\text{-}^\circ\text{ F.}}.$$

8. The apparatus of any one of claims 1, 2, 3 or 4 wherein said module layer is formed of one heat transfer layer and two first spacer layers.

9. The apparatus of any one of claims 1, 2, 3 or 4 wherein said module layer is formed of one first spacer layer and two heat transfer layers.

* * * * *